US005996226A

United States Patent [19]

Gibbs

[11] Patent Number: 5,996,226

[45] Date of Patent: Dec. 7, 1999

[54] METHOD OF MANUFACTURING PUSH ROD BALLS

[75] Inventor: Glen A. Gibbs, Warren, Mich.

[73] Assignee: ITT Manufacturing Enterprises, Inc., Wilmington, Del.

[21] Appl. No.: 08/997,654

[22] Filed: Dec. 23, 1997

[51] Int. Cl.[6] ..... B23P 15/00

[52] U.S. Cl. ..... 29/888.2; 29/888

[58] Field of Search ..... 29/888.2, 888; 123/90.61; 148/206, 229, 233, 240, 278

[56] References Cited

U.S. PATENT DOCUMENTS

| | | | |
|---|---|---|---|
| 2,434,080 | 1/1948 | Rosa | 29/888.2 |
| 2,975,775 | 3/1961 | Macura | 29/888.2 |
| 3,101,402 | 8/1963 | Gondek | 29/888.2 |
| 3,538,574 | 11/1970 | Hiroyuki et al. | 29/888.2 |
| 4,436,063 | 3/1984 | Usui | 29/888.2 |
| 4,794,894 | 1/1989 | Gill | 29/888.2 |
| 4,848,286 | 7/1989 | Bentz | 29/888.2 |

FOREIGN PATENT DOCUMENTS

| | | | |
|---|---|---|---|
| 2030481 | 4/1980 | United Kingdom | 29/888.2 |

*Primary Examiner*—I Cuda
*Attorney, Agent, or Firm*—Robert P. Seitter

[57] ABSTRACT

A process for manufacturing push rod balls including the steps of introducing a metal ball, having an exterior surface, into contact with a carbon enriched medium for an interval sufficient to diffuse carbon into metal matrix forming the exterior surface region and, then, rapidly cooling the carburized metal balls. After the carburized metal balls are cooled, a central bore is drilled through the body of the metal ball. After drilling, the metal ball is brought into contact with a hardening atmosphere at a suitable temperature for an interval sufficient to harden the metal region proximate to the exterior surface of the metal ball. After contact with the hardening atmosphere, the metal balls are oil quenched. The resulting push rod balls have an exteriorly oriented wear surface surrounding an interior core. The interior core is composed of a steel or steel alloy containing between about 0.1 and about 0.2% by weight carbon. A hardened case layer is of an essentially uniform depth is located between the exterior surface and the inner core. The push rod ball has a cylindrical throughbore transiting its diameter. The push rod ball can be positioned on a suitable push rod shaft to provide a push rod assembly in which the weld region connecting shaft to ball extends through the hardened case region into the central core of the push rod ball.

18 Claims, 2 Drawing Sheets

METHOD OF MANUFACTURING PUSH ROD BALLS

BACKGROUND OF THE INVENTION

1. Field of the Invention

The present invention relates to methods for manufacturing push rod balls for use in various devices such as internal combustion engines. More particularly, this invention pertains to streamlined processes for push rod ball manufacture and to a novel push rod ball and push rod assembly.

2. Brief Description of Relevant Art

Push rod balls are necessary for accurate and efficient function of the internal combustion engines, hydrostatic pumps and motors, compressors, etc. These balls range in size from diameters of approximately 2 mm to 12 mm. Push rod balls are generally composed of suitable durable metallic materials such as steel, steel composites such as CPM 10V and the like. The push rod ball is fastened to the hollow shaft of the push rod by means of a suitable weld. The push rod ball has throughbore which extends diametrically through body of the push rod ball and is positioned such that the throughbore of the push rod ball is positioned on the same center line as the push rod shaft. The push rod ball throughbore assists in fixturing during assembly and provides a lubricant passage through the unit.

Because of the constant wear and abrasion on the surface of the push rod ball, it is necessary to provide a durable external wear surface. An appropriate wear surface can provide increased part life and performance.

As presently manufactured, the rough manufactured balls are sorted according to size and then headed to orient the balls for subsequent processing. The balls are subjected to a soft grinding operation to provide essentially spherical geometry. After soft grinding, the essentially spheroid metal balls are carburized and hardened by maintaining the metal balls in a natural gas environment at a temperature of 1700° F. (926.6° C.) for an appropriate interval after which the balls are water quenched and laboratory inspected to ensure the efficiency and completeness of the carburization and hardening processes. The carburized hardened balls are annealed at a temperature between 1600° F. and 1800° F. (871° C. and 982° C.) in an oil bath and tumbled to clean. After an additional inspection, the annealed balls are drilled in an automatic drilling process to produce the appropriate throughbore. The drilled balls are subjected to another tumble cleaning process and dried then rehardened to repair any micro fractures or imperfections which may have been initiated in the exterior surface as a result of the drilling process. The rehardening process involves introducing the drilled balls into contact with a nitrogen-rich environment at a temperature above 1600° to 1800° F. (871° C. and 988° C.) along with subsequent oil quenching. The rehardened balls are subjected to finish grinding and polishing processes.

The resulting push rod balls have the cross-sectional profile as generally shown in FIG. 3. The push rod balls have a soft core with a hardened case region proximate to the outer wear surface. The hardened case region extends through the ball to the throughbore at the regions adjacent to the openings of the throughbore.

It can be appreciated that the conventional process is energy and labor intensive. Additionally, the amount of handling and processing necessary to produce functional push rod balls provides opportunity for processing imperfections and push rod ball parts which must be rejected for non-compliance with desired manufacturer specifications.

The push rod units manufactured with push rod balls produced by conventional processes exhibit a particular failure mode due to weakened or ineffective connection at the junction between the push rod and push rod ball. Without being bound to any theory, it is believed that this is due to the difficulty of achieving an effective weld to the through hardened material of the push rod ball.

It has been widely held in the relevant art that push rod ball manufacturing processes required each of the enumerated steps to produce functional, durable push rod balls. An alternate method of manufacturing push rod balls which results in long lasting durable components while providing savings in labor and/or energy costs or the costs related to handling steps would be highly desirable. It is also desirable to provide a push rod ball which can be welded to the push rod in a manner which eliminates or decreases the number of improper weldments or failures in the push rod unit.

SUMMARY OF THE INVENTION

The present process for producing push rod balls of the present invention comprises the steps of:

introducing at least one metal ball having an exteriorly oriented metal surface and a central core region into contact with a carbon-enriched environment at an elevated temperature for an interval sufficient to diffuse carbon into the exteriorly oriented metal surface of the metal ball;

after diffusion of carbon into the exterior surface of the metal ball, rapid cooling the metal ball while maintaining the carburized metal balls in contact with the carbon-enriched environment;

after rapidly cooling, drilling a central throughbore through the body of each respective metal ball;

after the drilling step, introducing the metal balls into contact with a neutral gaseous atmosphere which causes neither carburization nor decarburization at an elevated temperature sufficient to heat temper the metal balls; and after contacting the metal ball with the neutral atmosphere, rapid cooling the metal balls.

The balls can be cleaned and polished and inspected a suitable one post-quenching step or steps. After which they can be joined to the push rod shaft to make a push rod unit by any suitable manufacturing process.

The present invention also includes a push rod ball of novel composition comprising a spherical metal body having an exteriorly oriented wear surface surrounding an interior core region. The interior core is a metallic material having first lower concentrations of carbon. The core region material can be generally described as "soft". A hardened case region is interposed between the exterior wear surface of the spherical metal body and the central core region characterized by a second concentration of diffused carbon greater than the first concentration found in the central core region. This hardened case region has an essentially uniform depth. The spherical metal body is transited by a throughbore extending diametrically through the body.

BRIEF DESCRIPTION OF THE DRAWING

In the present description, reference is made to the following drawing in which.

DESCRIPTION OF THE PREFERRED EMBODIMENT

Figure 1:
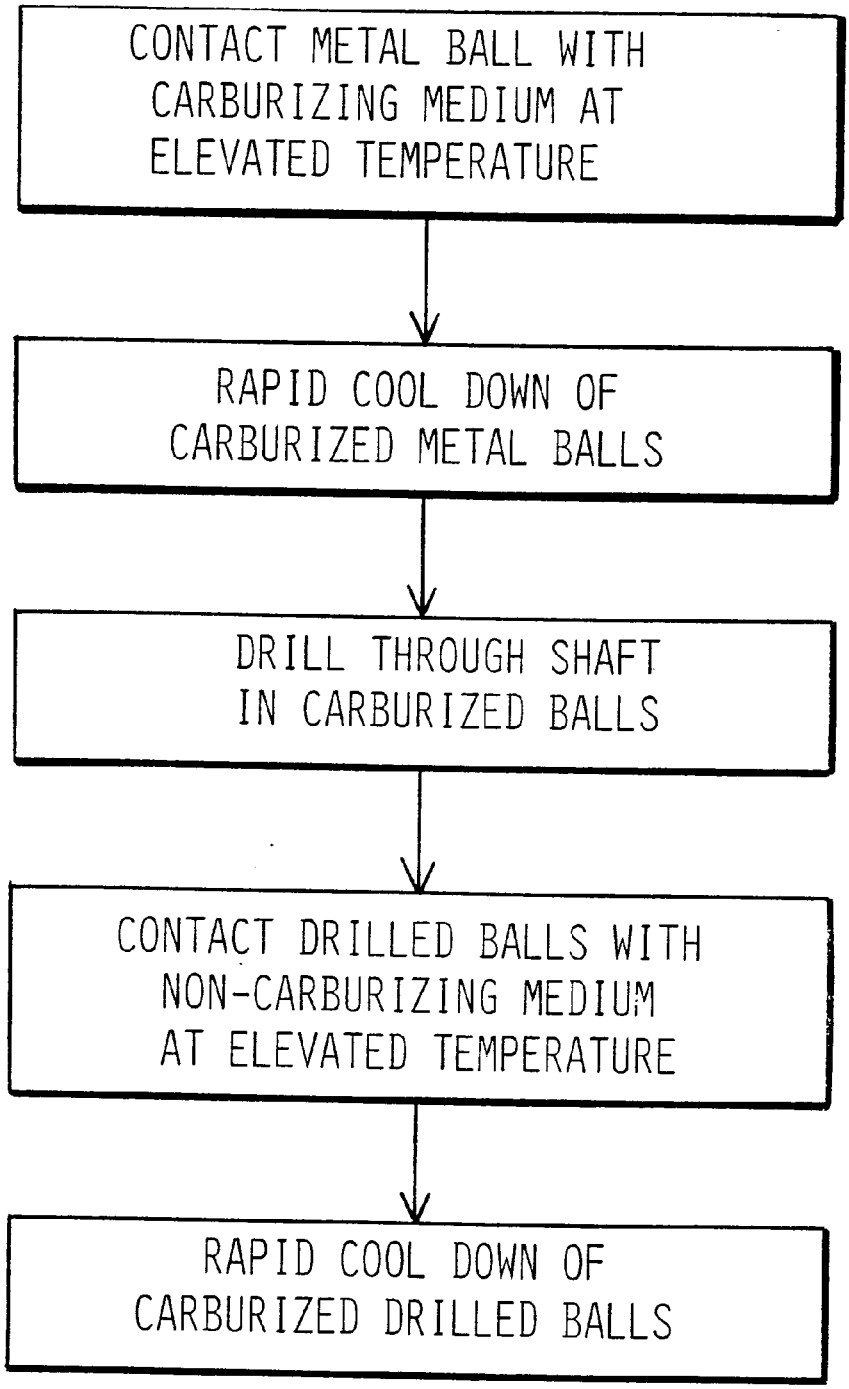
FIG. 1 is a process diagram of the method of the present invention.

The present invention is predicated upon the unexpected discovery that durable, functional push rod balls can be manufactured in a process in which organization of processing steps involving the diffusion of carbon into the metallic region proximate to the exterior surface of the push rod ball is precisely implemented and organized. It is also predicated upon the unexpected discovery that annealing operations, heretofore believed to be critical to successful manufacture of push rod balls can be eliminated by the process of the present invention. Contrary to long held belief, the method of the present invention provides a process for manufacturing push rod balls which eliminates the required annealing step as well as associated cleaning and inspection processes. It is also possible to forego quality checks associated with the prior art annealing step while still providing a push rod ball of superior wear characteristics.

Even more unexpectedly, the novel push rod balls of the present invention can be incorporated a push rod assembly which exhibits a significant decrease in failures, particularly those exhibited at the rod to ball junction.

The present invention is a process for manufacturing push rod balls which comprises the following steps:

introducing at least one metal ball, each metal ball having an exteriorly oriented metal surface, into a carbon-enriched environment maintained at a first elevated temperature for an interval sufficient to promote diffusion of carbon into metallic regions of each metal ball proximate to each respective exteriorly oriented surface;

after carbon diffusion, rapidly cooling the carburized metal balls from the elevated temperature to a second lower temperature;

after rapid cooling, drilling a central throughbore through the body of each respective carburized metal ball;

after the drilling step, introducing the metal balls having a throughbore located therein into contact with a hardening atmosphere at a third elevated temperature higher than the second temperature for an interval sufficient to harden a metal region underlying and proximate to the exterior surface region of each respective metal ball;

after contact with the hardening atmosphere, rapidly cooling the metal balls from the third temperature level.

The push rod balls can be cleaned and polished in suitable post-quenching steps.

Push rod balls suitable for use in internal combustion engines, hydrostatic pumps and motors, compressors, etc., can be manufactured by the process of the present invention. Push rod balls which can be manufactured by the process of the present invention can be of any size dictated by specifications of the given apparatus. Such push rod balls are spherical and generally have a diameter between about 2 mm and about 12 mm depending on particular apparatus specifications.

The push rod balls produced by the process of the present invention are made of suitable hardenable metals or metal alloys. Suitable metals include alloy steel, steel composites such as CPM 10V and mixtures thereof with alloy steel being most preferred.

The type of steel amenable to the process of the present invention is typically low carbon steel containing between about 0.10% and about 0.20% carbon. Suitable steel alloys which can be successfully employed in the process of the present invention include SAE 1013 and SAE 1018. Typically SAE 1013 steel alloys contain between about 0.11% and about 0.16% carbon while SAE 1018 has a carbon content between about 0.15% and about 0.20%. The compositions for these carbon steels is set forth in Table I.

TABLE I

| | SAE 1013 (wt %) | SAE 1018 (wt %) |
|---|---|---|
| Carbon | 0.11–0.16 | 0.15–0.20 |
| Manganese | 0.50–0.80 | 0.60–0.90 |
| Phosphorus | 0.04 (max) | 0.04 (max) |
| Sulphur | 0.05 (max) | 0.05 (max) |

Rough shaped push rod balls can be produced by any suitable method or obtained from numerous sources. Prior to being subjected to the process of the present invention, the rough unprocessed push rod balls are typically sorted by size and each ball is headed to provide spherical geometry. The resulting unprocessed spherical push rod balls are typically composed of low carbon steel and have an exteriorly oriented metal surface.

The spherical metal balls are then introduced into a carbon-enriched environment. The spherical metal balls are maintained in the carbon-enriched environment for an interval or dwell time sufficient to allow carbon to diffuse to essentially uniform depth in the metallic region proximate to the exterior surface of each push rod ball. Introduction into the carbon enriched environment, commonly referred to as carburization may occur in any suitable batch or continuous process.

The "carbon-enriched environment" suitable for use in the process of the present invention can include any suitable method by which carbon can be introduced into the defined region of the spherical metal balls. This process proceeds at an elevated temperature by maintaining the metal balls in contact with a suitable carbonaceous material. This can be accomplished by case carburizing either in a gas atmosphere, by roll or pack carburizing, or by liquid carburizing. Typically, gas carburization processes are employed in which the carbon-enriched environment is a gaseous material maintained at high temperature containing sufficient quantities of a hydrocarbon gas to create a carburizing atmosphere. Suitable gaseous materials are typically piped into a furnace in which the carburization occurs.

The carburizing atmosphere employed in the process of the present invention can be any suitable carbon-enriched gas which can be rendered reactive with the metal matrix of the push rod balls at the carburization temperatures defined in this invention. The carbon-enriched gas may be any gas suitable for carburization processes such as natural gas, propane, and other carbon containing gasses which would be readily known to the skilled artisan or others readily known to the skilled artisan. The choice of hydrocarbon gas and the total composition of the carburizing atmosphere is generally chosen to provide a gas which will most aggressively impart the diffused carbon at the lowest process temperature.

In the process of the present invention, the elevated or carburization temperature is sufficient to permit diffusion of carbon into the metal matrix but is generally below the temperature at which the metal such as steel or steel composite case hardens. When low carbon steel is used, a process temperature below about 1700° F. (927° C.) is employed, with a temperature greater than about 1500° F. (815.5° C.) and less than about 1700° F. (927° C.) being preferred.

In the process of the present invention, the metal balls are maintained in contact with the carbon-enriched atmosphere for an interval sufficient to permit carbon diffusion into the metal region proximate to the exterior surface of each of the metal balls. Carbon diffusion can occur either by interstitial or vacancy substitution. Preferably, the push rod ball is subjected to the carburization process for an interval sufficient to introduce between carbon into the metal matrix to a depth of about 0.045 to about 0.070 inches, with a depth of 0.060 to about 0.070 being preferred.

After dwell time in the carbon-enriched atmosphere, the carburized metal balls are allowed to cool from the elevated temperature to a second temperature below the carburization temperature. In the preferred embodiment, when the spherical metal balls are made of low carbon steels such as SAE 1013 to SAE 1018 are processed.

The cooling process employed is typically rapid and is effected by a conventional quenching process. In the preferred process, quenching from approximately the carburizing temperature (1500° F. to 1700° F.) occurs. Any suitable quenching medium may be employed with water being the preferred quenching medium. Quenching usually commences when the balls are at or near the carburizing temperature to rapidly bring the temperature down to a temperature at or below the appropriate second temperature range. The second temperature range after quenching can be at or near ambient (about 50° to about 90° F.) or a temperature low enough to facilitate post-quenching handling. Transfer to the quenching medium generally occurs in the carbon-enriched environment. The quenching step may proceed as a single quench procedure or as a multiple quench operation.

After cooling, the carburized spherical metal balls are subjected to appropriate drilling and chamfering steps to impart a central diametrical throughbore through the body of each respective spherical metal ball. The internal diameter of the drilled throughbore is determined by specifications for the finished product. Suitable chamfering operations can also occur to provide finished push rod balls with appropriate geometry to facilitate subsequent push rod assembly processes. Drilling and chamfering can be accomplished by any suitable method. Various automatic drilling operations and machines are known to those skilled in the art.

The drilled spherical metal balls are introduced into a hardening medium. The metal balls are maintained in contact with the hardening medium at a temperature sufficient to harden the carburized regions of the drilled metal balls. Preferably, the metal balls are introduced into a furnace containing the hardening medium at a temperature of 1600° F. (871° C.).

The hardening medium can be any suitable gaseous composition which will not induce additional carbon diffusion into the metal material of the spherical metal balls at temperatures at or above about 1600° F. The gaseous composition chosen will also prevent or retard decarburization from the metal material during the hardening process. Preferably, the hardening medium is preferably a gaseous nitrogenous material selected from the group consisting of nitrogen, ammonia, and mixtures thereof with an atmosphere containing elemental nitrogen being most preferred. Other suitable gaseous nitrogen containing atmospheres which would be known to those skilled in the art which could accomplish the listed objectives can be substituted for the gaseous nitrogenous materials enumerated.

In the preferred embodiment, where nitrogen is used as the hardening gas, the spherical metal balls are maintained in contact with the nitrogen atmosphere for an interval sufficient to harden the carburized region.

After the hardening step, the drilled metal balls are quenched in a suitable medium such as an oil bath from a temperature greater than about 1400° F. (800° C.). The resulting metal balls will have a hardened case region and a uniform hardened case depth of 0.040 to 0.070 inches. The resulting drilled metal balls can be subjected to appropriate cleaning steps such as tumbling in aqueous silicone solutions and tumbling in an aqueous lime wash.

The drilled, hardened spherical metal balls can be subjected to various post processing steps such as finish grinding, dimensional sorting and the like. Additionally, the finished spherical balls can be de-burred by suitable conventional methods and subjected to appropriate visual inspections as well as laboratory checks for metallurgical and dimensional specifications.

It is also within the purview of this invention to include pre-processing steps in the process of the present invention in which the spherical metal balls are initially formed. In such instances, it is anticipated that coils of cold heading wire would be descaled and cold headed into balls having a diameter approximate to the finished product. Such balls could be soft ground to the desired rough diameter prior to initial contact with the carburizing atmosphere.

Figure 2:
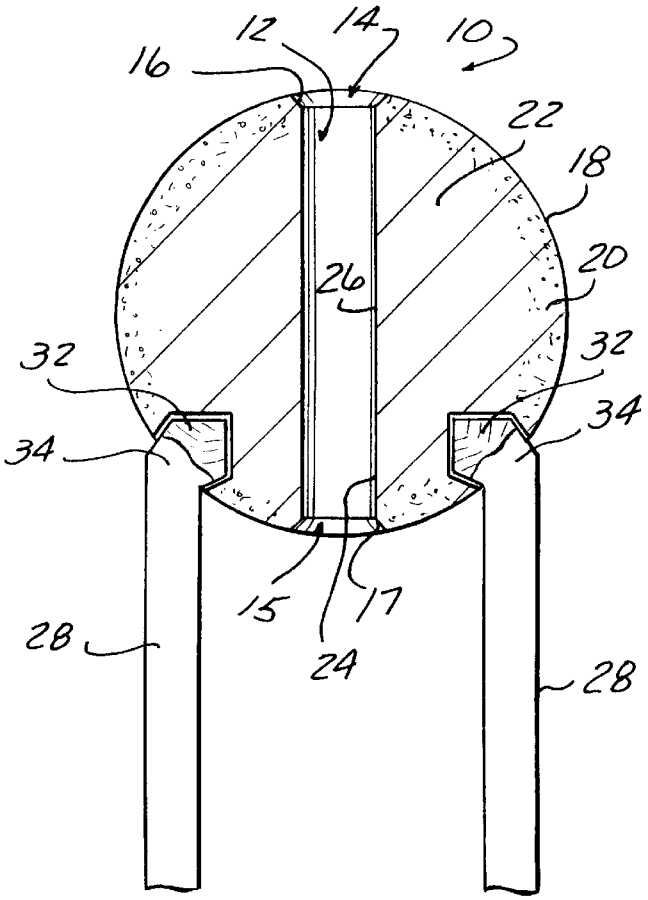
FIG. 2 is a cross sectional view of a push rod ball prepared by the process of the present invention shown in connection with a push rod shaft.

The push rod balls prepared from the process of the present invention exhibit unique characteristics. As shown in FIG. 2, the push rod ball of the present invention has a spherical metal body having a diameter between about 1 mm and about 20 mm with a diameter between about 2 mm and about 12 mm being preferred. The push rod ball 10 of the present invention includes a throughbore 12 extending diametrically through the central region of the spherical metal body with apertures 14, 15 located at each exit. These apertures 14, 15 can have diameters equal to the throughbore 12 or can be characterized by appropriate chamfers 16, 17 if desired.

The push rod ball 10 of the present invention includes a carburized hardened case region 18 located proximate to the exterior surface 20 of the push rod ball 10. The carburized hardened case region 18 surrounds a central core region 22. The carburized hardened case region 18 is characterized by elevated carbon levels relative to the softer central core region 22. In the preferred embodiment, the carburized and hardened case region 18 extends inward from the exterior surface 20 to a depth between about 0.045 and about 0.070 inch, with a depth between about 0.050 and about 0.060 inch being preferred.

The softer core region 22 of the push rod ball 10 is, preferably, composed of a suitable low carbon steel containing between about 0.10 and about 0.20%. Typically, the carbon content of the softer core region 22 is between about 0.13 and about 0.18% when alloys such as SAE 1013 are employed and between about 0.15% and about 0.18% when alloys such as SAE 1018 are employed.

The carburized and hardened case region 18 located proximate to the exterior surface 20 is characterized by elevated levels of diffused carbon. It is to be understood that the elevated levels of the carbon which characterize the region 18 are greatest proximate to the exterior surface 20 and become more diffuse in more interior regions of the core. The external surface 20 of the push rod ball 10 of the present invention is characterized by a smooth polished outer finish.

The bore 14 of push rod ball 10 is, preferably, defined by a cylindrical wall 24. The cylindrical wall 24 has a central region 26 which is generally composed of the core material, that is, low carbon steel such as SAE 1013 or 1018. The cylindrical wall 24 also has two opposed exterior regions located proximate to the outer apertures 14, 15 such as at chamfers 16, 17.

The push rod ball 10 of the present invention is uniquely adapted to use in combination with push rod shaft 28 to provide a fatigue resistant push rod assembly 30. As shown in FIG. 2, the push rod ball 10 is affixed to push rod shaft 28 by a suitable weld 32 located at the uppermost surface 34 of push rod shaft 28. The push rod shaft 28 is preferably composed of a steel alloy dissimilar to the alloy employed in push rod ball 10. Typically the push rod shaft 28 is made of SAE 1008 steel.

Attachment between push rod ball 10 and push rod shaft 28 is by a suitable weld 32 which extends circumferentially around the uppermost surface of push rod shaft 28. The weld 30 between push rod ball 10 and shaft 28 is generally accomplished by suitable solid phase welding methods with resistance welding being preferred. As seen in FIG. 2, weld 32 is defined by a weld zone or nugget extends to a depth into the push rod ball 10 through and beyond the case hardened region 20 into the low carbon core region 18 of push rod ball 10. The weld produced by weld 32 has an essentially triangular cross-sectional profile with the apex extending into the core material to a sufficient depth to provide a secure weld joint with the core material. The apex of the weld zone is characterized by minimal carbon diffusion into the zone from the surrounding base metal material and exhibits grain formation characteristic of the slower cooling rate phenomenon exhibited by low-carbon material. The associated fusion zone and adjacent zone which result from the welding process at and near the junction of the weld and base metal are also characterized by a granular structure evident of a slower cooling rate. The resulting weld 32 exhibits increases in resistance to root cracking.

Figure 3:
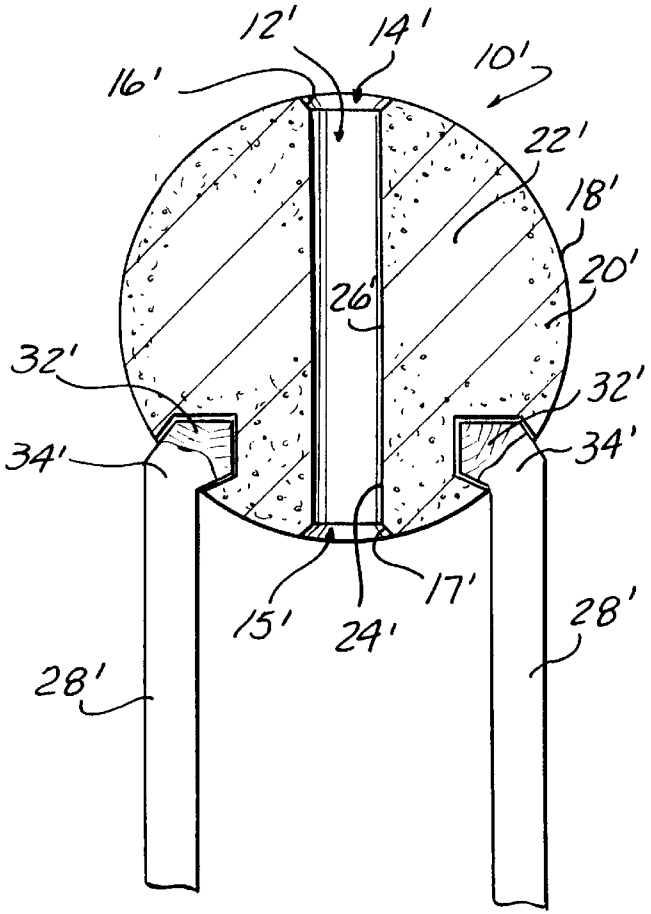
FIG-3 PRIOR ART
FIG. 3 is a cross-sectional view of a prior art push rod ball shown in connection with a push rod shaft.

This can be contrasted with the conventional push rod assembly 30' depicted in FIG. 3 which uses a push rod ball 10' produced by conventional methods. The case hardened region 20' extends over the surface 26 of bore 24. The case hardened region at the region around the apertures 15, 15' extends to a depth equal to more than twice the average depth of case at other regions of the push rod ball. Around the weld 32', the alloy of push rod ball 10' is through-hardened or rendered essentially that way by conventional manufacturing processes. Welds must necessarily be between the through-hardened material region and the shaft 28.

Having thus described the present invention, what is claimed is:

1. A process for producing push rod balls comprising the steps of:

introducing at least one metal ball having an exteriorly oriented metal surface, and a central core region into contact with a carbon-enriched environment at a first elevated temperature for an interval sufficient to diffuse carbon into the exterior surface of the spherical metal ball;

after diffusion of carbon into the exterior surface of the metal ball, rapidly cooling the metal ball from the elevated temperature to a second lower temperature;

after rapid cooling, drilling a central bore through the central core region of the metal ball;

after the drilling step, contacting the metal ball with a hardening medium at a third temperature, the elevated temperature higher than the second temperature and lower than the first elevated temperature, the metal ball maintained in contact with the hardening medium for an interval sufficient to harden a metal region at and adjacent to the exterior surface region of the metal ball; and after contact with the hardening medium, rapidly cooling the metal balls.

2. The process of claim 1 wherein the carbon-enriched environment is a gaseous atmosphere containing of natural gas, propane, and mixtures thereof in amounts sufficient to provide a quantity of carbon reactive with the exterior surface of the metal ball.

3. The process of claim 2 wherein the metal ball is maintained in contact with the gaseous atmosphere at a temperature between about 1600° F. and about 1800° F.

4. The process of claim 3 wherein the cooling step comprises exposing the metal ball to a carburizing atmosphere at a temperature below about 1500° F., for an interval sufficient to achieve cooling to a temperature suitable for post-carburization handling.

5. The process of claim 3 wherein the cooling step comprises quenching the metal balls in a quenching medium while the ball is maintained in the gaseous atmosphere.

6. The process of claim 5 wherein the quenching medium is water.

7. The process of claim 1 further comprising the step of chamfering a pair of essentially circular metal depressions on diametrically opposed locations on the exterior surface of the carburized metal ball, the chamfering step occurring prior to the drilling of the central throughbore, wherein an inner diameter of the chamfered depressions is greater than an inner diameter of the central throughbore.

8. The process of claim 1 wherein the hardening medium with which the metal ball is contacted after the drilling step is a non-carburizing gaseous material containing a nitrogenous compound, the nitrogenous compound consisting essentially of nitrogen, ammonia, and mixtures thereof.

9. The process of claim 8 wherein the hardening atmosphere consists essentially of nitrogen and the hardening atmosphere is maintained held at a process temperature between about 1600° F. and about 1800° F.

10. The process of claim 9 wherein the metal ball is allowed to cool in a quenching medium immediately following contact with the hardening atmosphere.

11. The process of claim 1 wherein the cleaning and polishing comprises the following steps:

abrasive grinding the metal ball to a finish diameter;

tumble washing the metal ball in an aqueous caustic solution;

drying the cleaned metal ball; and burnishing the cleaned ball to a finished polish.

12. The process of claim 1 wherein the metal ball consists essentially of a low carbon steel.

13. The process of claim 12 wherein the low carbon steel contains between about 0.10% and about 0.20% carbon.

14. A process for producing push rod balls comprising the steps of:

introducing a plurality of metal balls, each ball having an exteriorly oriented metal surface into contact with a carburizing gaseous atmosphere at a temperature sufficient to diffuse carbon into the exteriorly oriented metal surface of each metal ball;

after diffusion of such carbon into the exteriorly oriented metal surface of each metal ball, quenching the metal balls from the elevated carburizing to a second lower temperature, the cooling step occurring while the metal balls are maintained in the carburizing gaseous atmosphere;

drilling a central throughbore in each carburized metal ball after the cooling step;

contacting the drilled metal balls with a non-carburizing atmosphere at a temperature between about 1500° F. and about 1800° F. for an interval sufficient to harden the exteriorly oriented metal surface; and rapidly cooling the drilled metal balls after contact with the non-carburizing atmosphere.

15. The process of claim 14 wherein the carburizing gaseous atmosphere consists essentially of natural gas, propane, and mixtures thereof.

16. The process of claim 14 wherein the rapid cooling step in the carburizing atmosphere comprises quenching the metal balls in water.

17. The process of claim 14 wherein the non-carburizing gaseous atmosphere is maintained at a temperature between about 1600° F. and about 1800° F. is selected from the group consisting of nitrogen, ammonia, and mixtures thereof.

18. The process of claim 17 wherein the rapid cooling step after contact with the non-carburizing gaseous atmosphere consists essentially of quenching the metal balls in an oil quench medium.

* * * * *